US008134424B2

(12) United States Patent
Kato et al.

(10) Patent No.: US 8,134,424 B2
(45) Date of Patent: Mar. 13, 2012

(54) ELECTROSTATIC CONNECTOR

(75) Inventors: Shuichi Kato, Akiruno (JP); Susumu Kawata, Hachioji (JP); Makoto Honda, Odawara (JP)

(73) Assignees: Olympus Corporation, Tokyo (JP); Olympus Medical Systems Corp., Tokyo (JP)

( * ) Notice: Subject to any disclaimer, the term of this patent is extended or adjusted under 35 U.S.C. 154(b) by 622 days.

(21) Appl. No.: 12/257,612

(22) Filed: Oct. 24, 2008

(65) Prior Publication Data

US 2009/0111315 A1 Apr. 30, 2009

(30) Foreign Application Priority Data

Oct. 26, 2007 (JP) ..... 2007-279218

(51) Int. Cl.
*H01P 5/04* (2006.01)
*H01P 1/04* (2006.01)

(52) U.S. Cl. ..... 333/24 C; 333/260; 333/34

(58) Field of Classification Search ..... 333/32, 333/33, 24 C, 254, 255, 260, 250
See application file for complete search history.

(56) References Cited

U.S. PATENT DOCUMENTS 5,977,841 A * 11/1999 Lee et al. ..... 333/24 C

FOREIGN PATENT DOCUMENTS

| | | | |
|---|---|---|---|
| JP | 2004-511191 | A | 4/2004 |
| JP | 2006-287052 | A | 10/2006 |
| WO | 01/80444 | A1 | 10/2001 |

* cited by examiner

*Primary Examiner* — Benny Lee
*Assistant Examiner* — Hardadi Sumadiwirya
(74) *Attorney, Agent, or Firm* — Westerman, Hattori, Daniels & Adrian, LLP

(57) ABSTRACT

A connector for transmitting signals using electrostatic coupling, comprises an inner first conductor portion and an outer first conductor portion respectively connected to two signal lines, an inner electrode portion having a facing area larger than the cross-sectional area of the inner first conductor portion in the direction perpendicular to the direction of the common axis, an outer electrode portion outside it, an inner second conductor portion for electrically connecting between the inner first conductor portion and the inner electrode portion, and an outer second conductor portion outside it, wherein the ratio of outer diameter of the inner second conductor portion to inner diameter of the outer second conductor portion is set to provide substantially fixed characteristic impedance at every position along the direction of the common axis.

36 Claims, 5 Drawing Sheets

ELECTROSTATIC CONNECTOR

CROSS REFERENCE TO RELATED APPLICATION

This application claims benefit of Japanese Application No. 2007-279218 filed on Oct. 26, 2007; the contents of which are incorporated by this reference.

BACKGROUND OF THE INVENTION

1. Field of the Invention

The present invention relates to a connector for performing transmission of signals using electrostatic coupling.

2. Description of the Related Art

An electrical connector is used to perform transmission of signals in various electrical devices. In a typical electrical connector, electrical contacts facing each other are brought into contact to perform transmission of signals. In this case, the electrical contacts deteriorate as a result of long term use.

For this reason, there is an electrostatic coupling connector (or capacitance coupling connector) as means for performing transmission of signals in a contactless manner (no contact) which does not require any contact point.

For example, in WO2001/080444 as a first prior example, an apparatus for transmitting electrical energy or signals using electromagnetic coupling and electrostatic coupling (electrostatic induction) is disclosed.

In addition, in Japanese Patent Application Laid-Open Publication No. 2006-287052 as a second prior example, an electrostatic coupling apparatus is disclosed which can transmit signals even in the case of a structure in which one part rotates.

The second prior example provides a structure in which electrostatic capacitance is constituted by a first cylindrical electrode and a second cylindrical electrode arranged coaxially with the first cylindrical electrode in proximity thereto in an outer peripheral position and one of the first cylindrical electrode and the second cylindrical electrode is rotatable, enabling transmission of signals between the first cylindrical electrode and the second cylindrical electrode.

SUMMARY OF THE INVENTION

The present invention is a connector for transmitting signals with another electrode portion facing thereto insulated in terms of direct current using electrostatic coupling, comprises:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing the other electrode portion;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis.

A connector of the present invention has a first connector and a second connector connected so as to face each other insulated in terms of direct current using electrostatic coupling, at least one of the first connector and the second connector comprises:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing an inner electrode portion of the opposite connector;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis.

DETAILED DESCRIPTION OF THE PREFERRED EMBODIMENTS

Embodiments of the present invention will be described below with reference to the drawings.

Embodiment 1

Figure 1:
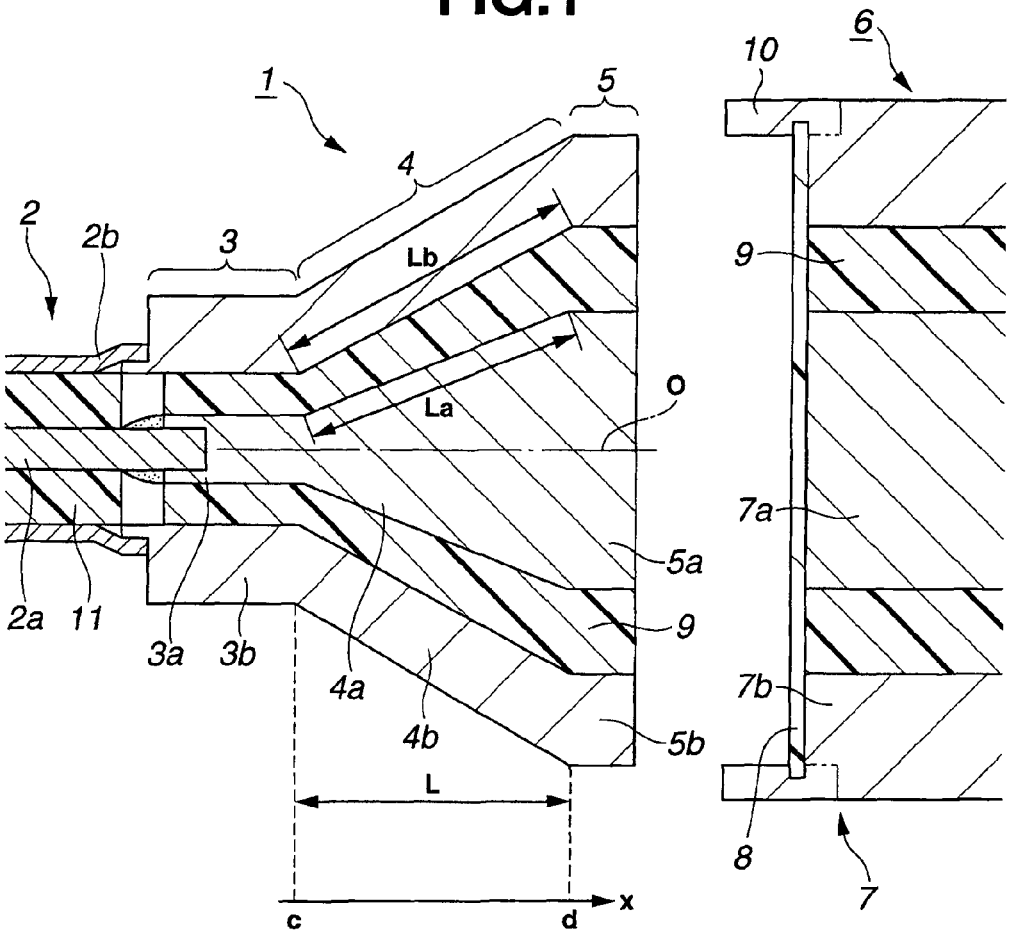
FIG. 1 is a vertical sectional view showing the structure of an electrostatic coupling connector of an embodiment 1 of the present invention.
Figure 2:
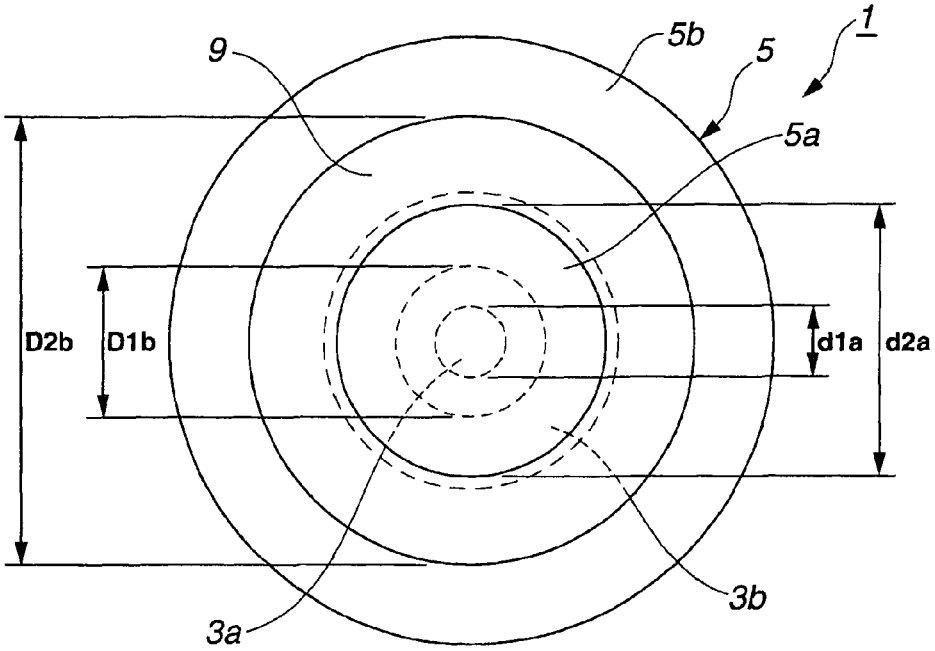
FIG. 2 is a front view of the electrostatic coupling connector of an embodiment 1.

FIGS. 1 and 2 relate to an embodiment 1 of the present invention. FIG. 1 shows the structure of an electrostatic coupling connector which is the embodiment 1 of the connector of the present invention in a vertical sectional view. FIG. 2 shows a front view seeing the structure of the electrostatic coupling connector from the electrode portion side.

As shown in FIG. 1, an electrostatic coupling connector 1 of the embodiment 1 of the present invention has a first conductor portion 3 formed on the proximal end side thereof connected to one end of a coaxial cable 2. Signals transmitted from the other end of the coaxial cable 2 to the one end of the same are transmitted via a second conductor portion 4 electrically connected to the first conductor portion 3 to an electrode portion 5 provided on an end portion of the second conductor portion 4.

Here, the first conductor portion 3, the second conductor portion 4 and the electrode portion 5 are formed integrally using metal such as brass, for example. However, separate bodies may be electrically connected. Alternatively, silver, gold or the like, which have low electrical resistance and good electrical conductivity, may be formed on the surface of them by plating or the like.

Alternatively, as will be described below, silver or the like of good electrical conductivity may be formed on the surface portion of the conductor (electrode) between an inner first conductor portion 3*a* and an outer first conductor portion 3*b* constituting the first conductor portion 3, between an inner second conductor portion 4*a* and an outer second conductor portion 4*b* constituting the second conductor portion 4, and between an inner electrode portion 5*a* and an outer electrode portion 5*b* constituting the electrode portion 5.

With the electrostatic coupling connector 1 of the embodiment 1 and another electrostatic coupling connector 6 to which the electrostatic coupling connector 1 is detachably connected, a connector for performing signal transmission by electrostatic coupling between both is formed.

When the electrostatic coupling connectors 1 and 6 are connected, the electrode portion 5 is in proximity to the electrode portion 7 of the electrostatic coupling connector 6 facing thereto. In this case, the electrode portion 5 and the electrode portion 7 face each other in proximity, spaced by the thickness of a thin insulating plate 8 interposed therebetween, for example.

In addition, for example, on an outer electrode portion 7*b* of the electrostatic coupling connector 6, a protruding portion 10 protruding to the electrostatic coupling connector 1 side is provided as a connector connecting portion, inside which the electrode portion 5 of the electrostatic coupling connector 1 is fitted thereby to set the both electrostatic coupling connectors 1 and 6 in the connection state.

In the example of FIG. 1, the protruding portion 10 is formed of the same conductor as the outer electrode portion 7*b*, where transmission of signals is performed by electrostatic coupling between the inner electrode portions 5*a* and 7*a* on the inner side. To perform transmission of signals by electrostatic coupling also between the outer electrode portions 5*b* and 7*b*, the portion shown by double-dotted dashed line of the protruding portion 10 may be formed of an insulator, for example.

In that connection state, a signal transmitted by the coaxial cable 2 is transmitted via the electrostatic coupling connector 1 of the embodiment 1 from the electrode portion 5 thereof to the electrode portion 7 facing the electrode portion 5 by electrostatic coupling or electrostatic induction.

Although the insulating plate 8 has a structure which insulates the whole end faces of the both electrode portions 5 and 7 in the specific example shown in FIG. 1, it may also have a structure which insulates only the portions of the inner electrode portion 5*a* and the inner electrode portion 7*a* facing thereto with the insulating plate 8 and brings the outer electrode portion 5*b* and the outer electrode portion 7*b* into electrical contact.

In addition, although transmission of signals is possible from the other electrostatic coupling connector 6 to the electrostatic coupling connector 1 side, the direction of transmission of signals is assumed to be the direction from the electrostatic coupling connector 1 to the other electrostatic coupling connector 6 side in the description in order to simplify the description.

The electrostatic coupling connector 1 has a rotationally symmetrical shape which is rotationally symmetrical about a central axis O thereof. Specifically, the first conductor portion 3, the second conductor portion 4 and the electrode portion 5 respectively comprise the inner first conductor portion 3*a* and the outer first conductor portion 3*b*, the inner second conductor portion 4*a* and the outer second conductor portion 4*b*, and the inner electrode portion 5*a* and the outer electrode portion 5*b*, having coaxial shapes (or coaxial structures) about the common central axis O. Signals are transmitted along the (axial) direction of this common axis.

In addition, a dielectric 9 of fluorine-based resin, for example, being electrically insulative, having low dielectric loss and having a certain dielectric constant is filled between the inner first conductor portion 3*a* and the outer first conductor portion 3*b*, between the inner second conductor portion 4*a* and the outer second conductor portion 4*b*, and between the inner electrode portion 5*a* and the outer electrode portion 5*b*.

The dielectric 9 is also filled between the inner electrode portion 7*a* and the outer electrode portion 7*b* which constitute the electrode portion 7 of the same size as the electrode portion 5, facing the electrode portion 5.

In addition, at the connecting portion with the first conductor portion 3, the inner second conductor portion 4*a* and the outer second conductor portion 4*b* of the second conductor portion 4 have the same outer and inner diameters as the inner first conductor portion 3*a* and the outer first conductor portion 3*b*, respectively.

For example, the inner second conductor portion 4*a* has the same outer diameter d1*a* as the inner first conductor portion 3*a*, and the outer second conductor portion 4*b* has the same inner diameter D1*b* as the outer first conductor portion 3*b* (with regard to d1*a*, D1*b*, see FIG. 2).

In addition, the second conductor portion 4 has a tapered shape with its diameter linearly increased toward the electrode portion 5 side; at the connecting portion with the electrode portion 5, the inner second conductor portion 4*a* and the outer second conductor portion 4*b* respectively have the same outer diameter d2*a* and inner diameter D2*b* as the inner electrode portion 5*a* and the outer electrode portion 5*b* (with regard to d2*a*, D2*b*, see FIG. 2).

It is assumed in the description that there is no change in the sizes of the first conductor portion 3 (the inner first conductor portion 3*a* and the outer first conductor portion 3*b*) and the electrode portion 5 (the inner electrode portion 5*a* and the outer electrode portion 5*b*) in terms of the direction of transmission of signals.

When the outer diameter of the inner second conductor portion 4*a* is d2*x* and the inner diameter of the outer second conductor portion 4*b* is D2*x* at any position in terms of the direction of transmission of signals from the connecting portion with the first conductor portion 3 to the connecting portion with the electrode portion 5 in the second conductor portion 4, the values of the outer diameter d2*x* and the inner diameter D2*x* vary with the ratio of D2*x*/d2*x* being constant.

Here, the suffix x in the outer diameter d2*x* and the inner diameter D2*x* represents a range from the coordinate position x=c of the connecting portion with the first conductor portion 3 along the signal transmission direction to the coordinate position x=d of the connecting portion with the electrode portion 5; the setting is such that the outer diameter d2*c*=d1*a*, the inner diameter D2*c*=D1*b* at the coordinate position x=c, and the outer diameter d2*d*=d2*a*, the inner diameter D2*d*=D2*b* at x=d. In addition, the length of the second conductor portion 4 is defined as the length L (=d−c) of d−c.

An inner conductor 2*a* and an outer conductor 2*b* of the coaxial cable 2 are respectively connected to the proximal ends of the inner first conductor portion 3*a* and the outer first conductor portion 3*b*. A dielectric 11 is filled between the inner conductor 2*a* and the outer conductor 2*b* of the coaxial cable 2.

Although the coaxial cable 2 is shown in FIG. 1 as an example of the signal transmitting member for transmitting signals to the inner first conductor portion 3*a* and the outer first conductor portion 3*b*, it is not limited thereto and may also be one of a coaxial tube structure the outer conductor of which is formed with a copper tube or the like, for example.

In the present embodiment, signal transmission is performed in the TEM mode (Transverse electromagnetic Mode) in the coaxial structure portion in which the dielectric is filled between the inner conductor and the outer conductor of the coaxial cable 2, the electrostatic coupling connector 1, the other electrostatic coupling connector 6 and the like.

In this case, when the outer diameter of the inner conductor is do, the inner diameter of the outer conductor is Do, and the square root of the relative dielectric constant εo of the dielectric filled therebetween is $(\epsilon o)^{1/2}$, the characteristic impedance Z is represented in general as $$Z=(138/(\epsilon o)^{1/2})\log(Do/do)[\Omega] \quad (1).$$

Here, log represents the common logarithm having 10 as the base.

The setting is such that when the outer diameter of the inner conductor 2*a* is d1, the inner diameter of the outer conductor 2*b* is D1 and the relative dielectric constant of the dielectric 11 is ε1 in the coaxial cable 2, the characteristic impedance Z is a predetermined characteristic impedance value Zo (for example, Zo=50 [Ω]) when do=d1, Do=D1, εo=ε1 are assigned in the formula (1).

In addition, in terms of the inner first conductor portion 3*a* and the outer first conductor portion 3*b* of the electrostatic coupling connector 1 of the present embodiment, when the outer diameter of the inner first conductor portion 3*a* is d1*a*, the inner diameter of the outer first conductor portion 3*b* is D1*b*, and the relative dielectric constant of the dielectric 9 is E1 as shown in FIG. 2, the outer diameter d1*a*, the inner diameter D1*b* and the relative dielectric constant ε1 are so set as to match the characteristic impedance Zo of the coaxial cable 2 when the formula (1) is applied. Here, although the dielectrics 9 and 11 have the same relative dielectric constant ε1, for example, they may be set at different values.

In addition, in terms of the electrode portion 5, the setting is such that when the outer diameter of the inner electrode portion 5*a* is d2*a* and the inner diameter of the outer electrode portion 5*b* is D2*b* as above, the characteristic impedance Z is a predetermined characteristic impedance value Zo (for example, Zo=50 [Ω]) when do=d2*a*, Do=D2*b*, εo=ε1 are assigned in the formula (1).

In addition, in the other electrostatic coupling connector 6, the electrode portion 7 facing the electrode portion 5 has the same size as the electrode portion 5. Specifically, the outer diameter of the inner electrode portion 7*a* in the electrode portion 7 is d2*a* and the inner diameter of the outer electrode portion 7*b* is D2*b*.

In addition, in terms of the second conductor portion 4, although the values of the outer diameter d2*x* and the inner diameter D2*x* vary as the position in the signal transmission direction varies, since the ratio of D2*x*/d2*x* is constant as described above, the characteristic impedance Z has the predetermined characteristic impedance value Zo.

Therefore, the electrostatic coupling connector 1 has a structure in which no impedance mismatch is generated in terms of the characteristic impedance. Thus, the electrostatic coupling connector 1 has a structure which can prevent the occurrence of reflection to perform signal transmission.

In addition, in the present embodiment, the difference between the values of surface conductor lengths La, Lb (the surface lengths of the tapered shapes) corresponding to (signal) transmission path lengths L'a, L'b for signal transmission of the outer surface of the inner second conductor portion 4*a* and the inner surface of the outer second conductor portion 4*b* in the second conductor portion 4 is restricted to a predetermined value V (>0) or less.

That is, $$(Lb-La)<V \quad (2)$$

is set. Since Lb>La, the inequality is shown not using the absolute value. Here, the surface conductor lengths La, Lb and the transmission path lengths L'a, L'b have the relationship:

$$L'a=(\epsilon 1)^{1/2}*La,\ L'b=(\epsilon 1)^{1/2}*Lb \quad (3),$$

for example.

Therefore, the formula (2) can also be represented, using the transmission path lengths L'a, L'b, as $$L'a-L'b<V' \quad (2').$$

Here, $V'=(\epsilon 1)^{1/2}*V$.

In the present embodiment, the common dielectric 9 having a certain dielectric constant is filled between the inner second conductor portion 4*a* and the outer second conductor portion 4*b*, and restriction is provided as in the formula (2) using the surface conductor length (restriction may also be provided as in the formula (2') using the transmission path length).

By such setting, the difference in arrival time can be suppressed in the case of transmitting signals from the connecting portion with the first conductor portion 3 to the connecting portion with the electrode portion 5 by means of the inner second conductor portion 4*a* side and the outer second conductor portion 4*b*.

Therefore, irregularity of the waveform of the electromagnetic field of the transmission mode at the time of transmission of signals can be suppressed and reflection and distortion of signals can be suppressed to perform good signal transmission.

In the case of the formula (2), when the gradient of increase of the diameter in the tapered shape is f (in the case of the outer surface of the inner second conductor portion 4*a*, *f*=(d2*a*−d1*a*)/L), the more the value of the gradient f is close to 1, the smaller the value (Lb−La) which corresponds to the arrival time difference can be.

Although the value of the outer diameter of the inner second conductor portion 4*a* is linearly increased in the present embodiment, it is non-linearly increased in a later-described embodiment.

In addition, as described above, in the other electrostatic coupling connector 6, the electrode portion 7 facing the electrode portion 5 is set to have the same size as the electrode portion 5 which has a large electrode area, so that reflection due to impedance mismatch upon transmission of signals can be suppressed as well as signals of low frequency range can be transmitted with little attenuation. Specifically, the outer diameter of the inner electrode portion 7*a* is d2*a* and the inner diameter of the outer electrode portion 7*b* is D2*b* in the electrode portion 7.

The electrostatic coupling connector 6 of the example shown in FIG. 1 is shown by means of an exemplary structure in which the diameters of the inner conductor portion and the outer conductor portion do not change in the direction of transmission of signals.

That is, the outer diameter of the inner conductor portion is equal to the outer diameter d2*a* of the inner electrode portion 7*a*, and the inner diameter of the outer conductor portion is equal to the inner diameter D2*b* of the outer electrode portion 7*b*.

Figure 3:
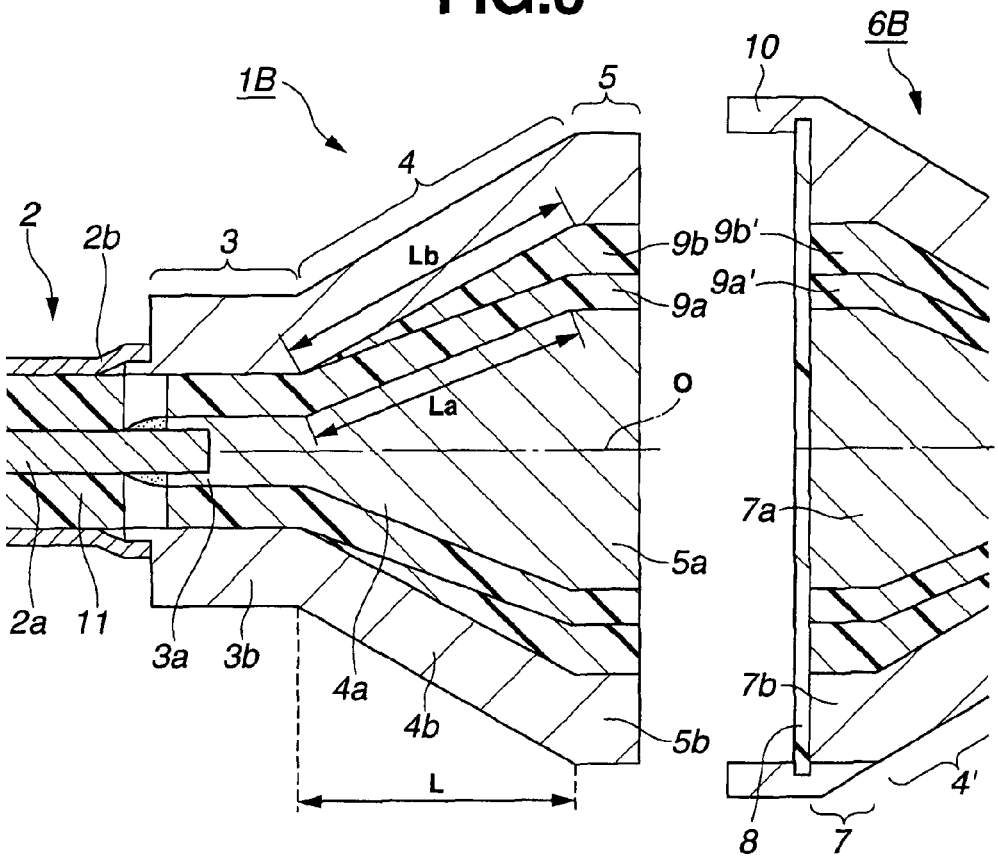
FIG. 3 is a vertical sectional view showing the structure of an electrostatic coupling connector of an embodiment 2 of the present invention.

However, the other electrostatic coupling connector 6 to which the electrostatic coupling connector 1 of the present embodiment is attachable and detachable is not limited to the exemplary structure shown in FIG. 1 but may also have a structure which changes in a tapered shape in the direction of transmission of signals in the same way as the electrostatic coupling connector 1, for example (see a tapered shape as in FIG. 3 as an example which relates to an embodiment 2 described later).

In the electrostatic coupling connector 1 thus configured, the inner second conductor portion 4*a* has its cross-sectional area increased in diameter in a tapered shape (more strictly, such that the cross-sectional area monotonically increases) along the axial direction of the common axis from the connection portion with the inner first conductor portion 3*a* up to the connecting portion with the inner electrode portion 5, and the outer second conductor portion 4*b* arranged outside thereof is set to have inner diameter which keeps a certain characteristic impedance with the outer diameter of the inner second conductor portion 4*a*.

Therefore, according to the electrostatic coupling connector 1, a signal transmitted from the coaxial cable 2 side, for example, to the electrostatic coupling connector 1 can be transmitted to the first conductor portion 3, the second conductor portion 4 and the electrode portion 5 without the occurrence of reflection due to impedance mismatch or the like, and further the signal can be transmitted from the electrode portion 5 to the electrode portion 7 in proximity thereto having the same size of facing area by means of electrostatic coupling while suppressing the occurrence of reflection.

In this case, since the electrode portion 5 is larger than the cross-sectional area of the first conductor portion 3 and is set to have the same size as the electrode portion 7 facing thereto, the occurrence of reflection due to impedance mismatch can be suppressed as well as attenuation upon transmission at the electrostatic coupling portion can be reduced (suppressed) in terms of signals or signal components in a low range (low frequency). In addition, the present embodiment can be realized with a simple configuration.

Embodiment 2

FIG. 3 shows an electrostatic coupling connector 1B of an embodiment 2 of the present invention. The electrostatic coupling connector 1 of the embodiment 1 has a structure in which a dielectric 9 having one relative dielectric constant (value) is filled between the inner conductor portion and the outer conductor portion.

On the other hand, in the electrostatic coupling connector 1B of the present embodiment, dielectrics 9*a*, 9*b* of different relative dielectric constants $\epsilon a$, $\epsilon b$ are filled at least between the inner second conductor portion 4*a* and the outer second conductor portion 4*b* in the second conductor portion 4.

In this case, the setting is such that the relative dielectric constant $\epsilon b$ of the dielectric 9*b* which is filled so as to contact with the inner surface of the outer second conductor portion 4*b* is smaller than the relative dielectric constant $\epsilon a$ of the dielectric 9*a* which is filled so as to contact with the outer surface of the inner second conductor portion 4*a*.

That is, $$\epsilon a > \epsilon b \tag{4}$$

is set.

In this case, in terms of the transmission path lengths L'a and L'b for transmission of signals in the outer surface of the inner second conductor portion 4*a* and the inner surface of the outer second conductor portion 4*b* in the second conductor portion 4, the values of relative dielectric constants are different in the formula (3).

By setting as in the formula (4), in the present embodiment, the signal transmission rate in the surface conductor length Lb on the outer second conductor portion 4*b* side can be higher than the signal transmission rate in the surface conductor length La on the inner second conductor portion 4*a* side.

Therefore, in the present embodiment, the predetermined value V' of the formula (2') can be set to be a small value even when the gradient of the tapered shape (as the surface shape) of the second conductor portion 4 is large. In addition, in this case the value V' of the formula (2') can, of course, be a small value, and can also be set to be 0. That is, the difference in arrival time of signals in the inner conductor and the outer conductor of the second conductor portion 4 can be further suppressed.

According to the present embodiment, reflection due to impedance mismatch can be avoided with a simple structure in the same way as the embodiment 1 as well as the electrostatic coupling connector 1B suitable for transmission of low frequency signals can be realized.

In addition, in the present embodiment, the gradient of the tapered shape of the second conductor portion 4 can be larger than in the embodiment 1. In other words, the length L of the second conductor portion 4 can be short. Therefore, the electrostatic coupling connector 1B of the present embodiment can reduce the size, weight and cost.

In addition, since the gradient of the tapered shape can be large as described above, the area of the electrode portion 5 can be large even if the length L of the second conductor portion 4 is short.

Although the other electrostatic coupling connector 6B to which the electrostatic coupling connector 1B is detachably connected may have a structure in which the size does not change in the direction of transmission of signals as shown in FIG. 1, the case of a structure similar to the electrostatic coupling connector 1B is shown in the example of FIG. 3.

In the electrostatic coupling connector 6B, the second conductor portion 4' adjacent to the electrode portion 7 has a structure similar to the second conductor portion 4. In addition, dielectrics 9*a*', 9*b*' similar to the dielectrics 9*a*, 9*b* in the case of the electrode portion 5 are filled between the inner electrode portion 7*a* and the outer electrode portion 7*b* in the electrode portion 7.

In the electrostatic coupling connector 1B shown in FIG. 3, two dielectrics 9*a*, 9*b* are filled in the second conductor portion 4 and the electrode portion 5, for example. On the other hand, the first conductor portion 3 is shown by means of an exemplary structure in which only one dielectric 9*a*, for example, is filled in the interior space. In addition, in the electrostatic coupling connector 1B shown in FIG. 3, the characteristic impedance of the second conductor portion 4 is set to be continuous at the connecting portion with the first conductor portion 3 and the connecting portion with the electrode portion 5. Therefore, the structure can suppress the occurrence of reflection upon transmission of signals.

Figure 4:
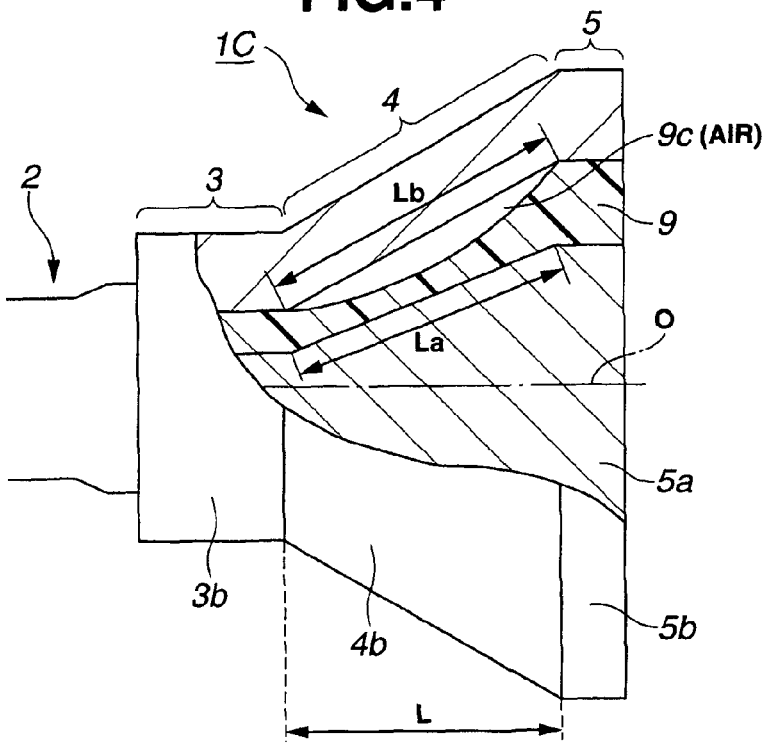
FIG. 4 is a side view showing the structure of an electrostatic coupling connector of a variation of the embodiment 2 with part thereof cut away.

In addition, as the dielectric 9*b* in FIG. 3, air may be adopted, for example. FIG. 4 shows an electrostatic coupling connector 1C of a first variation in which a dielectric 9*c* adopting air as the dielectric 9*b* in FIG. 3 is provided. In addition, in FIG. 4, the same dielectric 9 as the embodiment 1 is used as the dielectric 9*a*.

When the dielectric 9*b* is air, the dielectric 9*b* portion may simply be air in the same way as in FIG. 3 (however, since the value of dielectric constant differs from that of the dielectric 9*b*, strictly the tapered shape differs).

However, when air is used, the strength of support for the electrode portion 5 decreases, for example. For this reason, in the example of FIG. 4, the structure is such that the dielectric 9*c* of air is formed only in the second conductor portion 4 portion and the dielectric 9 is filled in the first conductor portion 3 and the electrode portion 5 on both ends thereof, thereby securing sufficient strength for supporting.

Also in the case of the structure shown in FIG. 4, the outer surface of the inner second conductor portion 4*a* of the second conductor portion 4 is in close contact with the dielectric 9, and the inner peripheral surface of the outer second conductor portion 4*b* contacts with the dielectric 9*c* of air.

Embodiment 3

Figure 5:
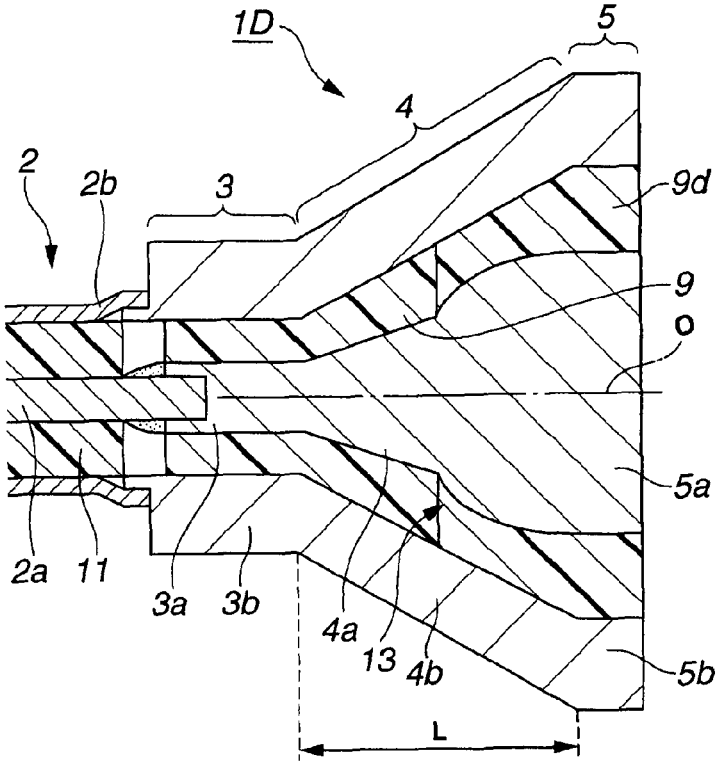
FIG. 5 is a vertical sectional view showing the structure of an electrostatic coupling connector of an embodiment 3 of the present invention.

FIG. 5 shows an electrostatic coupling connector 1D of an embodiment 3 of the present invention. The electrostatic coupling connector 1D of the present embodiment has a structure similar to the electrostatic coupling connector 1 of an embodiment 1 up to the midway portion of the second conductor portion 4 in the first conductor portion 3 side of the second conductor portion 4.

In the portion which is in the electrode portion 5 side of the midway position (also referred to as the boundary position), a dielectric 9*d* having a dielectric constant smaller than the dielectric 9 used in the first conductor portion 3 side is filled between the inner second conductor portion 4*a* and the outer second conductor portion 4*b* in the second conductor portion 4, for example.

In this case, the dielectric 9*d* may be air. In this case, there may be no filling between the inner second conductor portion 4*a* and the outer second conductor portion 4*b*.

In addition, in the vicinity of the boundary position, the shape of the outer surface of the inner second conductor portion 4*a* is protruding outwardly in the radial direction so as to form a curved surface portion 13 smoothly bending in the direction of transmission of signals, as shown in FIG. 5.

That is, since the value of the dielectrics 9, 9*d* changes stepwise at the boundary position, the outer diameter of the inner second conductor portion 4*a* smoothly protrudes as the curved surface portion 13 in order to restrain the amount of change of the characteristic impedance around that position.

By thus generating a curved surface shape portion in the outer surface of the inner second conductor portion 4*a*, the signal transmission path at this portion can be larger (than in the case of the above-described tapered shape, that is, a conical surface). The configuration is in other respects the same as an embodiment 1 or the like.

In the present embodiment having such structure, effects of an embodiment 1 can be retained and further the length L of the second conductor portion 4 can be short as in an embodiment 2. In addition, as described in an embodiment 2, the size can be reduced as well as the area of the electrode portion 5 can be large even when the length L of the second conductor portion 4 is short.

Embodiment 4

Figure 6:
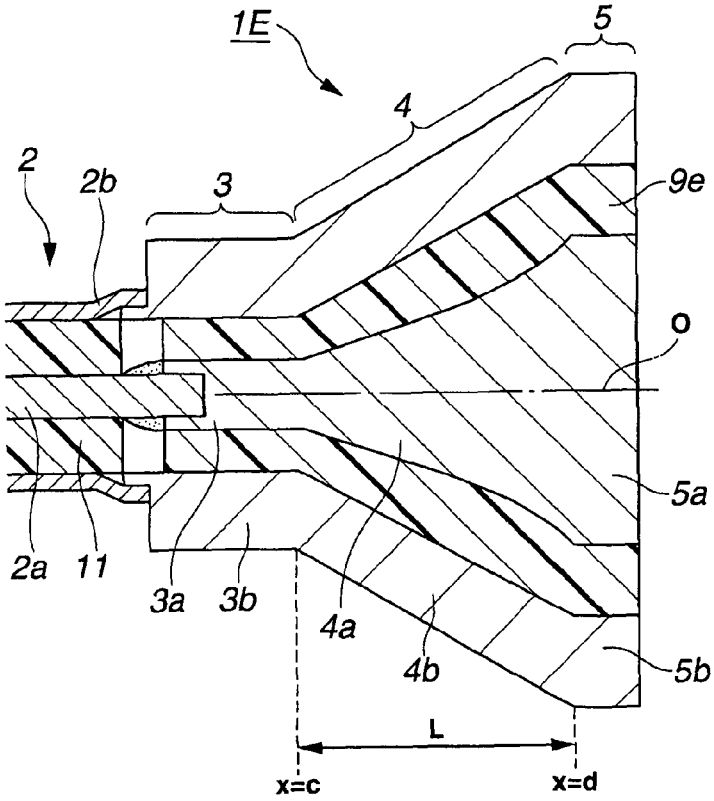
FIG. 6 is a vertical sectional view showing the structure of an electrostatic coupling connector of an embodiment 4 of the present invention.

FIG. 6 shows an electrostatic coupling connector 1E of an embodiment 4 of the present invention. In the electrostatic coupling connector 1E of the present embodiment, a dielectric 9*e* having a dielectric constant which substantially continuously varies to be smaller with advancing in the direction of transmission of signals in the second conductor portion 4 is filled in place of the dielectric 9 having a certain dielectric constant in the electrostatic coupling connector 1 of the embodiment 1, for example.

Figure 7:
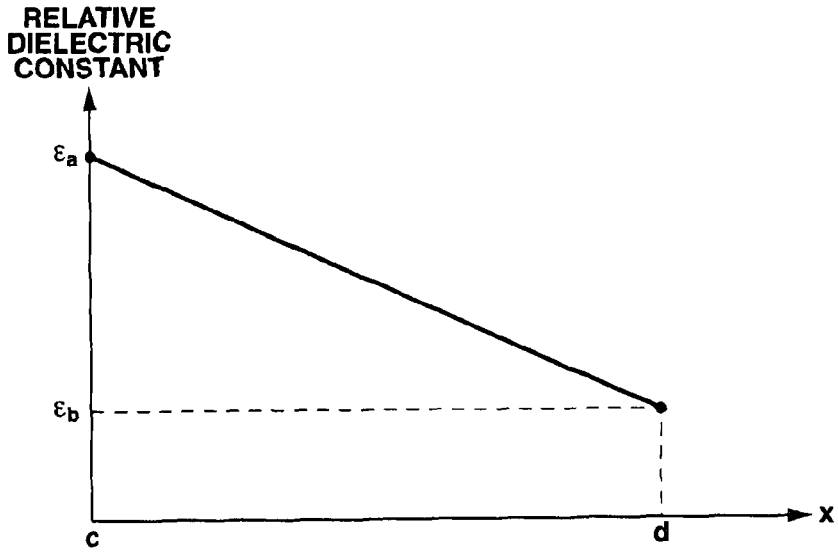
FIG. 7 is a diagram showing the relative dielectric constant of a dielectric used in the embodiment 4 in the direction of transmission of signals.

In this case, a characteristic example of the relative dielectric constant of the dielectric 9*e* in the direction of transmission of signals is shown in FIG. 7. In the example shown in FIG. 7, the ratio of mixture of a dielectric 9*a* of fluorine-based resin, for example, and a dielectric 9*b*, for example, having a dielectric constant smaller than that of the former is varied so that the relative dielectric constant in the direction of transmission of signals varies linearly and continuously.

As shown in FIG. 7, the dielectric 9*e* has the relative dielectric constant $\epsilon a$ of the dielectric 9*a* at the connecting portion with the first conductor portion 3 where x=c, and has the value of the relative dielectric constant $\epsilon b$ of the dielectric 9*b* at the connecting portion with the electrode portion 5 where x=d. The variation is not limited to linear one as shown in FIG. 7.

In addition, air may be used as the dielectric 9*b*. In this case, the ratio at which minute volume of air is mixed in the dielectric 9*a* may be varied continuously, for example, to form the dielectric 9*e* of fluorine-based resin or the like in the form of a sponge. In this case, the value of the relative dielectric constant can be substantially 1 at the connecting portion with the electrode portion 5 where x=d.

In addition, in the present embodiment, since the value of the dielectric constant gradually decreases along the direction of transmission of signals in this way, for the characteristic impedance Z of the formula (1) to be the predetermined characteristic impedance value Zo, the outer diameter of the inner second conductor portion 4*a* can be varied more greatly than in the case of filling with the dielectric 9.

In other words, (according to the structure of the dielectric 9*e* of the present embodiment as compared to the case of filling with the dielectric 9), when the predetermined impedance value Zo is set in order to avoid impedance mismatch, the outer diameter of the inner second conductor portion 4*a*, that is, the gradient of the surface of the tapered shape can be large as compared to the inner diameter of the outer second conductor portion 4*b*.

In addition, since the outer diameter portion of the inner second conductor portion 4*a*, that is, the surface conductor portion length thereof can be large in this way, the formula (2') can be satisfied even when the length L of the second conductor portion 4 is short. Thus the present embodiment also has effects similar to the embodiment 2.

Embodiment 5

Figure 8:
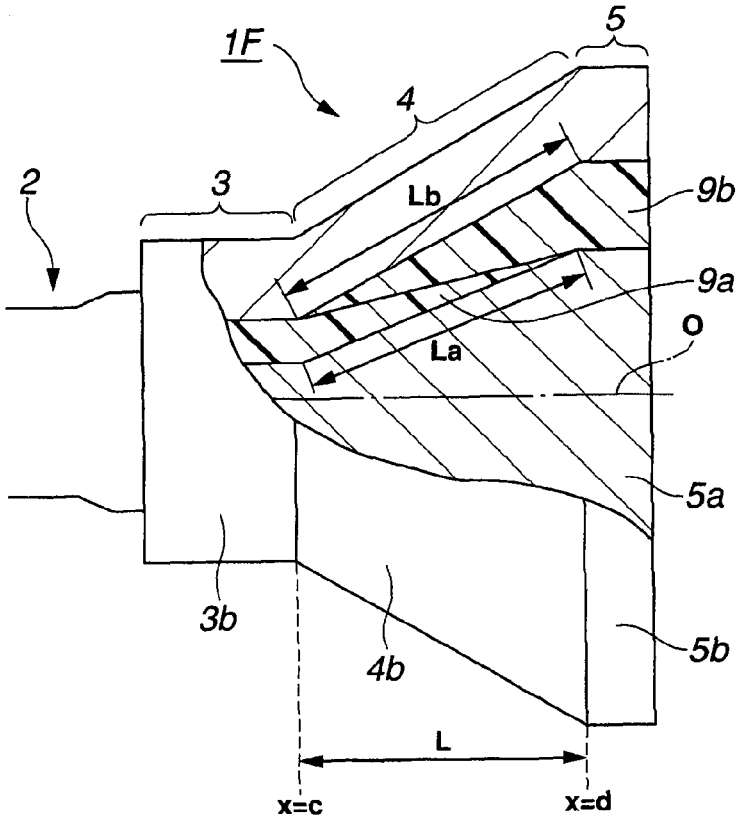
FIG. 8 is a side view showing the structure of an electrostatic coupling connector of an embodiment 5 of the present invention with part thereof cut away.

FIG. 8 shows an electrostatic coupling connector 1F of an embodiment 5 of the present invention. The electrostatic coupling connector 1F of the present embodiment is similar to the electrostatic coupling connector 1E of the embodiment 4 and therefore can be regarded as a variation of the embodiment 4.

The electrostatic coupling connector 1F of the present embodiment has a characteristic of the dielectric constant of the hollow portion between the inner second conductor portion 4*a* and the outer second conductor portion 4*b* in the second conductor portion 4 varying to be smaller substantially continuously with advancing toward the direction of transmission of signals, in the same way as the electrostatic coupling connector 1E of the embodiment 4.

Figure 9:
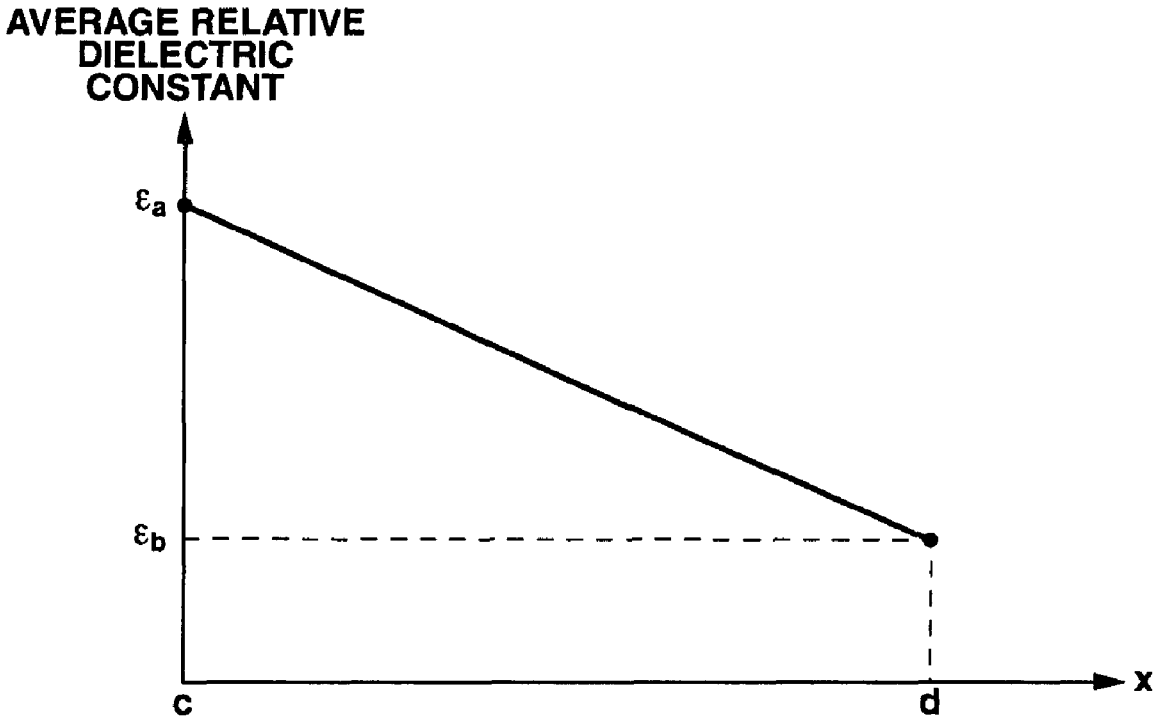
FIG. 9 is a diagram showing the average relative dielectric constant of two dielectrics used in the embodiment 5 in the direction of transmission of signals.

FIG. 9 shows the characteristic of the average relative dielectric constant at every position x in the direction of transmission of signals in the case of the present embodiment. This characteristic is the same as FIG. 7. However, since the relative dielectric constant changes stepwise in the radial direction in the present embodiment, the value of FIG. 9 is the average of the two relative dielectric constants in the radial direction.

While the relative dielectric constant in the hollow portion is set to be a uniform value in the radial direction in the case of the embodiment 4, two dielectrics 9*a*, 9*b* are arranged such that the dielectric constant changes stepwise in the radial direction in the present embodiment.

In the present embodiment, the setting is such that at least the side contacting with the inner second conductor portion 4*a* has large dielectric constants and the side contacting with the outer second conductor portion 4*b* has small dielectric constants.

The present embodiment has substantially the same effects as in the case of the embodiment 4.

Embodiments configured such as by partially combining the above-described embodiments and the like are also part of the present invention. In addition, although the above-described embodiments and the like are described by means of the case of electrostatic coupling connectors for performing signal transmission by means of electrostatic coupling, they can also applied to cases other than electrostatic coupling.

For example, when one desires to perform signal transmission by directly connecting two coaxial cables of different cross-sectional sizes, to the thinner coaxial cable side may the electrostatic coupling connector 1 of the embodiment 1, for example, and to the other coaxial cable may the electrostatic coupling connector 6 respectively be connected to perform transmission of signals by means of the electrostatic coupling connectors 1, 6. However, in this case the insulating plate 8 is removed. Also in such a case, signal transmission can be performed with reduced reflection as compared to the case of directly connecting two coaxial cables of different cross-sectional sizes.

Having described the embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. A connector for transmitting signals with another electrode portion facing thereto insulated in terms of direct current using electrostatic coupling, comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing the other electrode portion;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein between the inner second conductor portion and the outer second conductor portion is arranged a dielectric in which a dielectric constant of a portion contacting with the outer second conductor portion is smaller than a dielectric constant of a portion contacting with the inner second conductor portion.

2. The connector according to claim 1, wherein air is used as the dielectric in the portion contacting with the outer second conductor portion, as well as a dielectric having a dielectric constant larger than the air is used as the dielectric in the portion contacting with the inner second conductor portion.

3. The connector according to claim 1, wherein the inner first conductor portion and the outer first conductor portion are respectively connected to an inner signal line and an outer signal line of a coaxial cable.

4. The connector according to claim 1, wherein the inner electrode portion and the outer electrode portion have a shape rotationally symmetrical about a central axis of the inner first conductor portion.

5. The connector according to claim 1, wherein a dielectric is respectively arranged between the inner first conductor portion and the outer first conductor portion, between the inner second conductor portion and the outer second conductor portion and between the inner electrode portion and the outer electrode portion.

6. The connector according to claim 5, wherein the dielectric includes fluorine-based resin.

7. The connector according to claim 1, wherein a value of outer diameter of the inner second conductor portion linearly increases along the direction of the common axis toward the inner electrode portion.

8. The connector according to claim 1, wherein a value of outer diameter of the inner second conductor portion non-linearly increases along the direction of the common axis toward the inner electrode portion.

9. A connector for transmitting signals with another electrode portion facing thereto insulated in terms of direct current using electrostatic coupling, comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing the other electrode portion;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein a dielectric is arranged between the inner second conductor portion and the outer second conductor portion such that a dielectric constant on the inner electrode portion side is small at a predetermined position toward the inner electrode portion along the direction of the common axis, as well as the ratio of outer diameter of the inner second conductor portion to inner diameter of the outer second conductor portion is set to be larger in the inner electrode portion side of the predetermined position.

10. The connector according to claim 9, wherein the inner first conductor portion and the outer first conductor portion are respectively connected to an inner signal line and an outer signal line of a coaxial cable.

11. The connector according to claim 9, wherein the inner electrode portion and the outer electrode portion have a shape rotationally symmetrical about a central axis of the inner first conductor portion.

12. The connector according to claim 9, wherein a dielectric is respectively arranged between the inner first conductor portion and the outer first conductor portion, between the inner second conductor portion and the outer second conductor portion and between the inner electrode portion and the outer electrode portion.

13. The connector according to claim 12, wherein the dielectric includes fluorine-based resin.

14. The connector according to claim 9, wherein a value of outer diameter of the inner second conductor portion linearly increases along the direction of the common axis toward the inner electrode portion.

15. The connector according to claim 9, wherein a value of outer diameter of the inner second conductor portion nonlinearly increases along the direction of the common axis toward the inner electrode portion.

16. A connector for transmitting signals with another electrode portion facing thereto insulated in terms of direct current using electrostatic coupling, comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing the other electrode portion;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein a dielectric is arranged between the inner second conductor portion and the outer second conductor portion such that a dielectric constant gradually decreases toward the inner electrode portion side along the direction of the common axis, as well as the ratio of outer diameter of the inner second conductor portion to inner diameter of the outer second conductor portion gradually increases toward the inner electrode portion side along the direction of the common axis.

17. The connector according to claim 16, wherein between the inner second conductor portion and the outer second conductor portion is arranged a dielectric in which the dielectric constant of a portion contacting with the outer second conductor portion is smaller than the dielectric constant of a portion contacting with the inner second conductor portion.

18. The connector according to claim 16, wherein the inner first conductor portion and the outer first conductor portion are respectively connected to an inner signal line and an outer signal line of a coaxial cable.

19. The connector according to claim 16, wherein the inner electrode portion and the outer electrode portion have a shape rotationally symmetrical about a central axis of the inner first conductor portion.

20. The connector according to claim 16, wherein a dielectric is respectively arranged between the inner first conductor portion and the outer first conductor portion, between the inner second conductor portion and the outer second conductor portion and between the inner electrode portion and the outer electrode portion.

21. The connector according to claim 20, wherein the dielectric includes fluorine-based resin.

22. The connector according to claim 16, wherein a value of outer diameter of the inner second conductor portion linearly increases along the direction of the common axis toward the inner electrode portion.

23. The connector according to claim 16, wherein a value of outer diameter of the inner second conductor portion nonlinearly increases along the direction of the common axis toward the inner electrode portion.

24. A connector for transmitting signals with another electrode portion facing thereto insulated in terms of direct current using electrostatic coupling, comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing the other electrode portion;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein difference between a signal transmission path length from a connection portion with the inner first conductor portion to a connection portion with the inner electrode portion in an outer surface of the inner second conductor portion and a signal transmission path length from a connection portion with the outer first conductor portion to a connecting portion with the outer electrode portion in an inner surface of the outer second conductor portion is set to be a predetermined value or less.

25. The connector according to claim 24, wherein the inner first conductor portion and the outer first conductor portion are respectively connected to an inner signal line and an outer signal line of a coaxial cable.

26. The connector according to claim 24, wherein the inner electrode portion and the outer electrode portion have a shape rotationally symmetrical about a central axis of the inner first conductor portion.

27. The connector according to claim 24, wherein a dielectric is respectively arranged between the inner first conductor portion and the outer first conductor portion, between the inner second conductor portion and the outer second conductor portion and between the inner electrode portion and the outer electrode portion.

28. The connector according to claim 27, wherein the dielectric includes fluorine-based resin.

29. The connector according to claim 24, wherein a value of outer diameter of the inner second conductor portion linearly increases along the direction of the common axis toward the inner electrode portion.

30. The connector according to claim 24, wherein a value of outer diameter of the inner second conductor portion nonlinearly increases along the direction of the common axis toward the inner electrode portion.

31. A connector having a first connector and a second connector connected so as to face each other insulated in terms of direct current using electrostatic coupling, at least one of the first connector and the second connector comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing an inner electrode portion of an opposite connector;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein between the inner second conductor portion and the outer second conductor portion is arranged a dielectric in which a dielectric constant of a portion contacting with the outer second conductor portion is smaller than a dielectric constant of a portion contacting with the inner second conductor portion.

32. The connector according to claim 31, wherein air is used as the dielectric in the portion contacting with the outer second conductor portion, as well as a dielectric having a dielectric constant larger than the air is used as the dielectric in the portion contacting with the inner second conductor portion.

33. A connector having a first connector and a second connector connected so as to face each other insulated in terms of direct current using electrostatic coupling, at least one of the first connector and the second connector comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing an inner electrode portion of an opposite connector;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein a dielectric is arranged between the inner second conductor portion and the outer second conductor portion such that a dielectric constant on the inner electrode portion side is small at a predetermined position toward the inner electrode portion along the direction of the common axis, as well as the ratio of outer diameter of the inner second conductor portion to inner diameter of the outer second conductor portion is set to be larger in the inner electrode portion side of the predetermined position.

34. A connector having a first connector and a second connector connected so as to face each other insulated in terms of direct current using electrostatic coupling, at least one of the first connector and the second connector comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing an inner electrode portion of an opposite connector;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein a dielectric is arranged between the inner second conductor portion and the outer second conductor portion such that a dielectric constant gradually decreases toward the inner electrode portion side along the direction of the common axis, as well as the ratio of outer diameter of the inner second conductor portion to inner diameter of the outer second conductor portion gradually increases toward the inner electrode portion side along the direction of the common axis.

35. The connector according to claim 34, wherein between the inner second conductor portion and the outer second conductor portion is arranged a dielectric in which the dielectric constant of a portion contacting with the outer second conductor portion is smaller than the dielectric constant of a portion contacting with the inner second conductor portion.

36. A connector having a first connector and a second connector connected so as to face each other insulated in terms of direct current using electrostatic coupling, at least one of the first connector and the second connector comprising:

an inner first conductor portion and an outer first conductor portion respectively connected to two signal lines and arranged coaxially;

an inner electrode portion having a facing area larger than a cross-sectional area of the inner first conductor portion in a direction perpendicular to a direction of the common axis, and facing an inner electrode portion of an opposite connector;

an outer electrode portion arranged outside the inner electrode portion;

an inner second conductor portion for electrically connecting between the inner first conductor portion and the inner electrode portion; and an outer second conductor portion arranged outside the inner second conductor portion for electrically connecting between the outer first conductor portion and the outer electrode portion, wherein a ratio of outer diameter of the inner second conductor portion to inner diameter of the outer second conductor portion is set to provide substantially fixed characteristic impedance at every position of the inner second conductor portion and the outer second conductor portion along the direction of the common axis, and wherein difference between a signal transmission path length from a connection portion with the inner first conductor portion to a connection portion with the inner electrode portion in an outer surface of the inner second conductor portion and a signal transmission path length from a connection portion with the outer first conductor portion to a connecting portion with the outer electrode portion in an inner surface of the outer second conductor portion is set to be a predetermined value or less.

* * * * *